US009429913B2

(12) United States Patent
Gruenig et al.

(10) Patent No.: US 9,429,913 B2
(45) Date of Patent: Aug. 30, 2016

(54) COAXIAL DISENGAGEABLE WHEELS FOR A TIMEPIECE MOVEMENT

(71) Applicant: ETA SA Manufacture Horlogere Suisse, Grenchen (CH)

(72) Inventors: Daniel Gruenig, Sugiez (CH); Baptist Wyssbrod, Nidau (CH); David Benjamin Kraehenbuehl, Bettlach (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/856,841

(22) Filed: Sep. 17, 2015

(65) Prior Publication Data

US 2016/0098011 A1 Apr. 7, 2016

(30) Foreign Application Priority Data

Oct. 2, 2014 (EP) ..... 14187570

(51) Int. Cl.

| | |
|---|---|
| ***G04B 13/02*** | (2006.01) |
| ***G04B 11/00*** | (2006.01) |
| ***G04B 13/00*** | (2006.01) |
| ***G04B 19/23*** | (2006.01) |
| ***G04B 19/253*** | (2006.01) |

(52) U.S. Cl.

CPC ..... *G04B 11/008* (2013.01); *G04B 13/002* (2013.01); *G04B 13/023* (2013.01); *G04B 19/235* (2013.01); *G04B 19/2532* (2013.01)

(58) Field of Classification Search

CPC .... G04B 27/00; G04B 19/253; G04B 19/00; G04B 13/002; G04B 13/023; G04B 11/008; G04B 19/235; G04B 19/2532

See application file for complete search history.

(56) References Cited

U.S. PATENT DOCUMENTS 4,372,687 A 2/1983 Krasovsky et al.
4,422,777 A * 12/1983 Nakamura ..... G04B 27/00 368/185

(Continued)

FOREIGN PATENT DOCUMENTS

| | | |
|---|---|---|
| EP | 0 959 392 A1 | 11/1999 |
| EP | 2 068 210 A2 | 6/2009 |
| FR | 2 429 460 A1 | 1/1980 |

OTHER PUBLICATIONS

European Search Report issued Apr. 13, 2015 in European Application 14187570, filed on Oct. 2, 2014 (with English Translation).

*Primary Examiner* — Sean Kayes

(74) *Attorney, Agent, or Firm* — Oblon, McClelland, Maier & Neustadt, L.L.P.

(57) ABSTRACT

Device with coaxial disengageable wheels for a timepiece movement including an input wheel, an output wheel, a hub, and a jumper mechanism including a spring and positioning elements defining a certain number of discrete angular positions of the input wheel with respect to the output wheel around an axis of rotation. The positioning elements including hollow elements and protruding elements, the spring being configured to apply an elastic force pushing the protruding elements against the hollow elements to couple the wheels to each other below a disengagement torque. The protruding elements and the hollow elements extend in the axial direction and the spring is configured to apply an elastic force in the axial direction.

14 Claims, 4 Drawing Sheets

(56) References Cited

U.S. PATENT DOCUMENTS 4,922,475 A * 5/1990 Scholer ..... G04C 21/205
368/252

5,383,165 A * 1/1995 Vaucher ..... G04B 19/25
368/185

5,636,184 A * 6/1997 Boyd ..... G04B 27/005
368/185

* cited by examiner

COAXIAL DISENGAGEABLE WHEELS FOR A TIMEPIECE MOVEMENT

This application claims priority from European Patent Application No. 14187570.8 filed Oct. 2, 2014, the entire disclosures of which is hereby incorporated herein by reference.

FIELD OF THE INVENTION

The present invention concerns a device with coaxial disengageable wheels for a timepiece movement. In particular, the invention concerns coaxial wheels coupled by a jumping elastic member to allow the disengagement of one wheel from the other. One application consists of driving a date disc, in addition to a time indicator hand, and of permitting correction of the position of the date disc, for example when the month has more than 31 days. Another application is for driving a second time zone display hand, for example GMT (Greenwich Mean Time), and permitting modification of the position of the hand for the selected second time zone.

BACKGROUND OF THE INVENTION

In conventional movements, it is known to use a system of two coaxial wheels with a coupling by means of a spring fixed to the first wheel and pressing radially on a third wheel integral with the second wheel. The known coupling system therefore essentially has three levels and provides a jumper spring that acts radially on a toothing of a third wheel. To overcome this radial elastic force, a disengagement torque must be exerted on one of the two wheels while the other has a sufficiently high reaction torque to permit application of said disengagement torque. The third toothed wheel defines a plurality of discrete relative angular positions for the two wheels. Provided the relative torque between the two wheels is lower than the disengagement torque, the two wheels rotate integrally. Applying a disengagement torque between the two wheels changes the relative angular position by a desired number of steps. This construction takes up a relatively large amount of space as the spring generally has lobes which occupy a large surface area to achieve the required elastic properties. Further, this construction is complex and fragile because the shape of the spring is relatively complex and the spring has a thin section to achieve the aforementioned required elastic properties. Furthermore, the diameter of the third wheel is limited by the space required to mount the radially acting spring, which limits the number of jump steps in one complete revolution.

SUMMARY OF THE INVENTION

It is an object of the invention to provide a device with coaxial disengageable wheels for a timepiece movement which is compact, accurate and reliable over a long period of use.

It is another object of the invention to provide a device with coaxial disengageable wheels for a timepiece movement which easily permits fine adjustment of one wheel with respect to the other.

It is advantageous to provide a device with coaxial disengageable wheels for a timepiece movement which is easy to produce and therefore economical. Further, the invention is intended to be easily adapted to various variants with steps having different angular distances.

The objects of the invention are achieved by a mechanism with coaxial disengageable wheels for a watch movement according to claim 1. The dependent claims describe advantageous aspects of the invention.

The present invention concerns a device with coaxial disengageable wheels for a timepiece movement which includes an input wheel, an output wheel, a hub, and a jumper mechanism including a spring and positioning elements defining a certain number of discrete angular positions of the input wheel with respect to the output wheel around an axis of rotation. The positioning elements include hollow elements and protruding elements. The spring is configured to apply an elastic force pushing the protruding elements against the hollow elements to couple the wheels to each other below a disengagement torque. The protruding elements and the hollow elements extend in the axial direction and the spring is configured to apply an elastic force in the axial direction.

In one embodiment, the positioning elements include one or more balls forming the protruding elements, the balls being housed in ball housings in the form of holes disposed either in the input or output wheel, and the hollow elements are formed in a surface of the other wheel.

In another embodiment, the spring is entirely formed in either said input or output wheel, and said protruding elements are made in the form of protuberances on the elastic arms of the spring.

According to an advantageous embodiment, there is a plurality of protruding elements distributed in a uniform manner around the axis of rotation.

According to an advantageous embodiment, the spring is in the form of disc that is essentially flat or of small thickness, including a base portion forming the central hole, configured to be mounted around the hub, and an elastic portion including an elastic arm whose end is configured to press the protruding element into one of said hollow elements.

According to an advantageous embodiment, the spring is formed from a stamped metal sheet.

According to an advantageous embodiment, the spring includes a securing portion with a central orifice fixed to the hub.

According to an advantageous embodiment, the input wheel includes the hollow elements and the output wheel includes or is integral with the spring.

In the present invention, there is also described a timepiece movement including a device with disengageable wheels, one of the wheels of the device being engaged with a drive wheel of a drive device of the movement and the other wheel of the device being engaged with a correction wheel of a correction device of the movement.

The disengageable wheel device may also engage with a date disc drive wheel.

The movement may also include a hand or another display member mounted on the hub of the disengageable wheel device.

Other advantageous objects and aspects of the invention will appear upon reading the claims, and the detailed description of embodiments below.

BRIEF DESCRIPTION OF THE DRAWINGS

The invention will be described below with reference to the annexed drawings, given by way of non-limiting example, and in which.

DETAILED DESCRIPTION OF THE INVENTION

Figure 1:
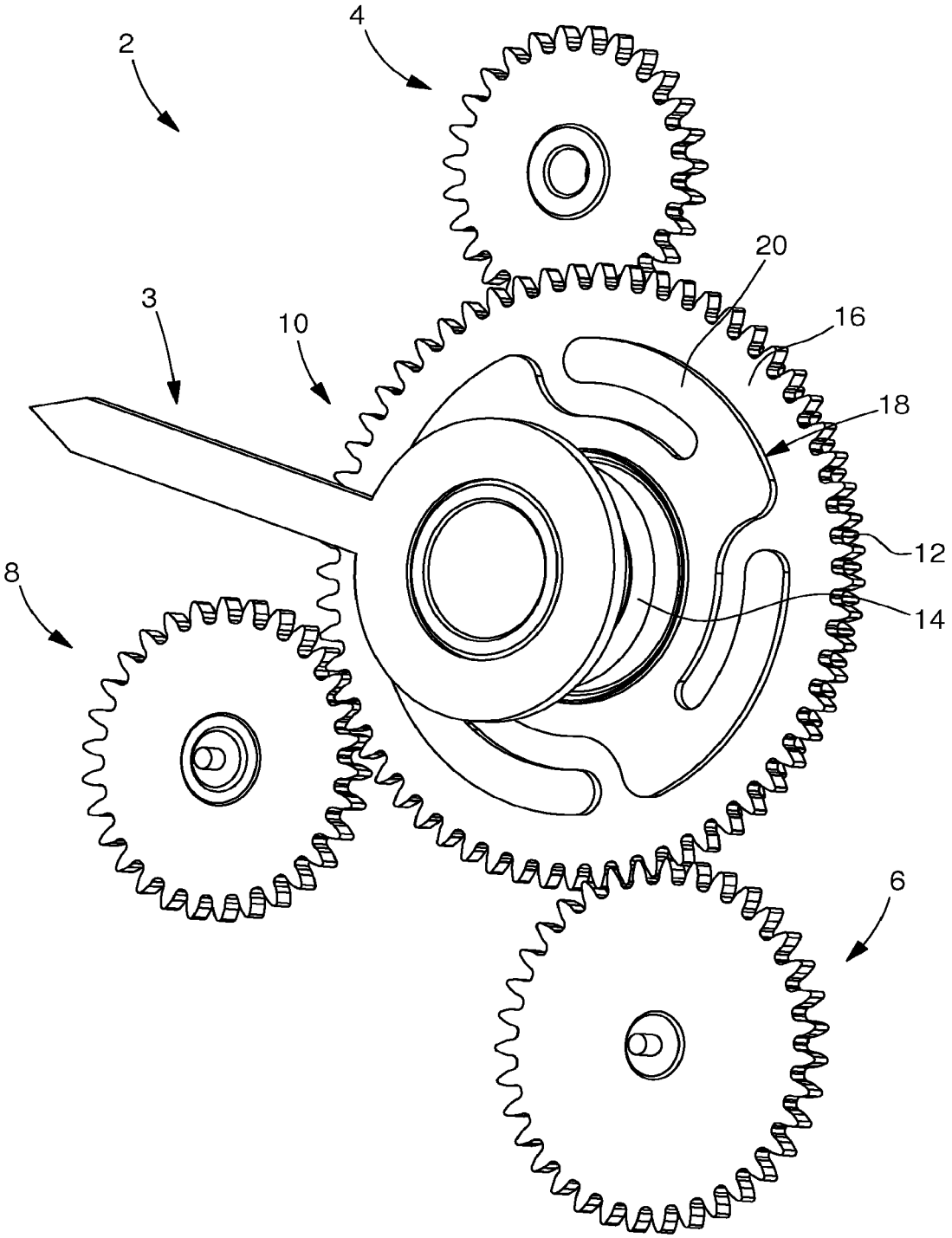
FIG. 1 is a schematic perspective view of one part of a timepiece movement including a disengageable wheel device according to a first embodiment of the invention.

Referring to the Figures, starting with FIG. 1, one part of a timepiece movement 2 includes a disengageable wheel device 10 engaged with a drive wheel 4 of a drive device (not illustrated) and with a correction wheel 8 of a correction device (not illustrated). The disengageable wheel device 10 may also engage with a drive wheel 6 of a date disc (not illustrated).

The disengageable wheel device 10 includes an input wheel 12, an output wheel 16, a hub 14 and a jumper mechanism 18. A hand 3 or another display member may be mounted on hub 14. In the illustrated embodiments, hub 14 includes a central hole 40 permitting the passage of one or more coaxial arbors (not illustrated), for example for the device displaying the hours, minutes and/or seconds.

Jumper mechanism 18 is configured to allow input wheel 12 to undergo a certain rotation with respect to output wheel 16 over an angular distance defined by one or more notches by applying a relative torque between the two wheels beyond a certain threshold, called the disengagement torque. Input wheel 12 includes teeth 50 engaging with teeth of drive wheel 4, and input wheel 12 is thus driven by the drive wheel. Output wheel 16 also includes teeth 50 engaging with teeth of correction wheel 8. According to the variant, the teeth 50 of output wheel 16 engage with the teeth of a drive wheel 6 which is coupled to a date disc or other mechanism for the display of a time related value.

Input wheel 12 includes a central orifice 32 configured to house a section 38 of hub 14. In the illustrated embodiments, the central orifice has a slightly larger diameter than wheel section 38, so as to allow input wheel 12 to rotate freely with respect to hub 14. In this embodiment, output wheel 16 has a central orifice 52 configured to be pressed or riveted onto a securing section 36 of hub 14 so that output wheel 16 is integral with hub 14. It is, however, possible, in a variant, to reverse this configuration, namely so that the input wheel is integral with the hub and the output wheel can rotate with respect to the hub insofar as correction wheel 8 is not required to correct the position of hand 3. Hub 14 may be a separate part assembled to one of the wheels as in the illustrated embodiments, but it is possible, in a variant, to form the hub as an integral part of either the input or output wheel.

In an advantageous variant, hand 3 is used to indicate a second time zone with respect to the main time display of the timepiece movement, however, the time zone indication must be able to be changed without changing the main time indication of the watch. A time zone operating on a 24 hour schedule will require 24 positions or more in a variant indicating the half hours, namely 48 positions, since in some countries time is graduated into smaller units than the hour. It will be noted that, in a variant, the second time zone may have a 12 hour display.

When it is desired to correct the time zone or the position of the date disc, a torque is applied to correction wheel 8, causing output wheel 16 to turn when the torque thereon exceeds the disengagement torque of jumper mechanism 18, input wheel 12 being locked by drive wheel 4. In the illustrated variant, by applying a sufficiently high torque to correction wheel 8, it is thus possible to turn output wheel 16 and hand 3 (made integral with the output wheel by hub 14) and the date drive device meshing with the output wheel.

Jumper mechanism 18 includes a spring 20 and positioning elements 22 defining a certain number of discrete angular positions of one wheel with respect to the other wheel of disengageable wheel device 10. In the invention, the spring is configured to apply an elastic force in an axial direction, the axial direction corresponding to a direction parallel to the axis of rotation A of wheels 12, 16 of disengageable wheel device 10.

Positioning elements 22 include hollow elements 24 and protruding elements 26; protruding elements 26 engage in hollow elements 24 in an axial direction and generate, under the action of spring 20, a torque making the wheels rotate integrally. While the torque applied between the two wheels remains lower than the disengagement torque defined by the maximum torque required to make the wheels rotate integrally, input wheel 12 and output wheel 16 remain coupled and rotate together. The disengagement torque is defined, on the one hand, by the geometry of the protruding elements and hollow elements engaged therein, and on the other hand, by the axial thrust force applied by spring 20.

One of the important advantages of this configuration is that it is possible to have the positioning elements close to the periphery of wheels 12, 16 and thus to enjoy the largest possible diameter for defining the discrete angular positions and therefore the number of jumps or notches per revolution.

Another advantage of this configuration is that the spring for applying an axial force is relatively simple to construct and assemble to the device. This also makes it possible to obtain a robust, reliable mechanism that can be easily calibrated to define with high precision the desired disengagement torque.

Figure 2A:
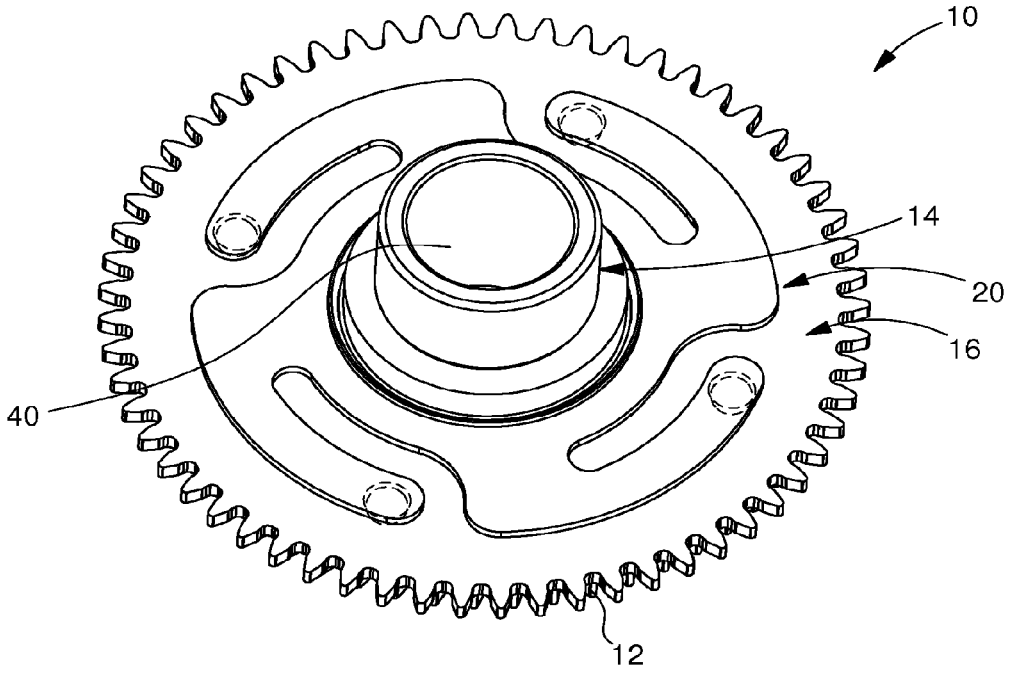
FIG. 2*a* is a perspective view of a disengageable wheel device according to the first embodiment of the invention.
Figure 2B:
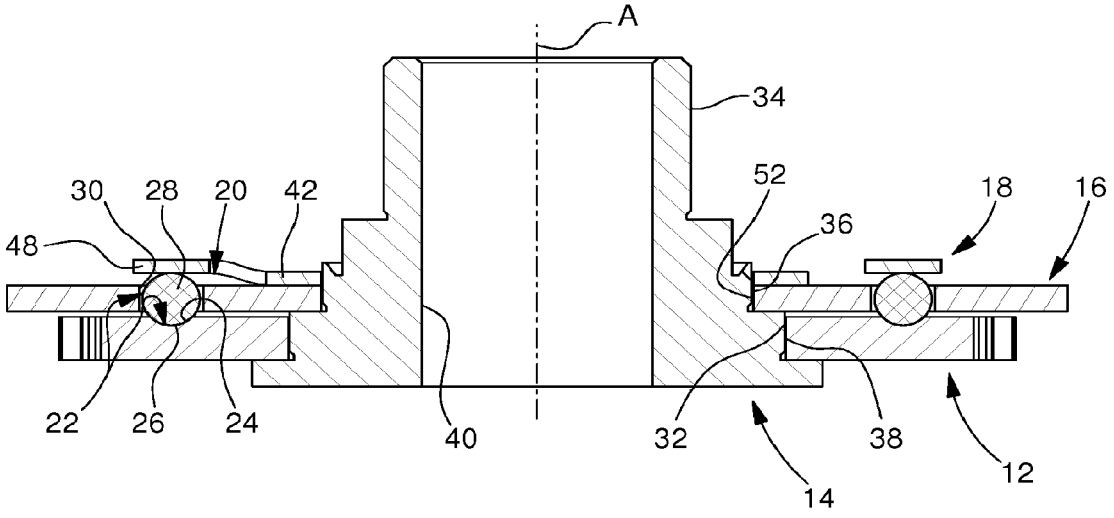
FIG. 2*b* is a cross-section of the device of FIG. 2*a;*
Figure 2C:
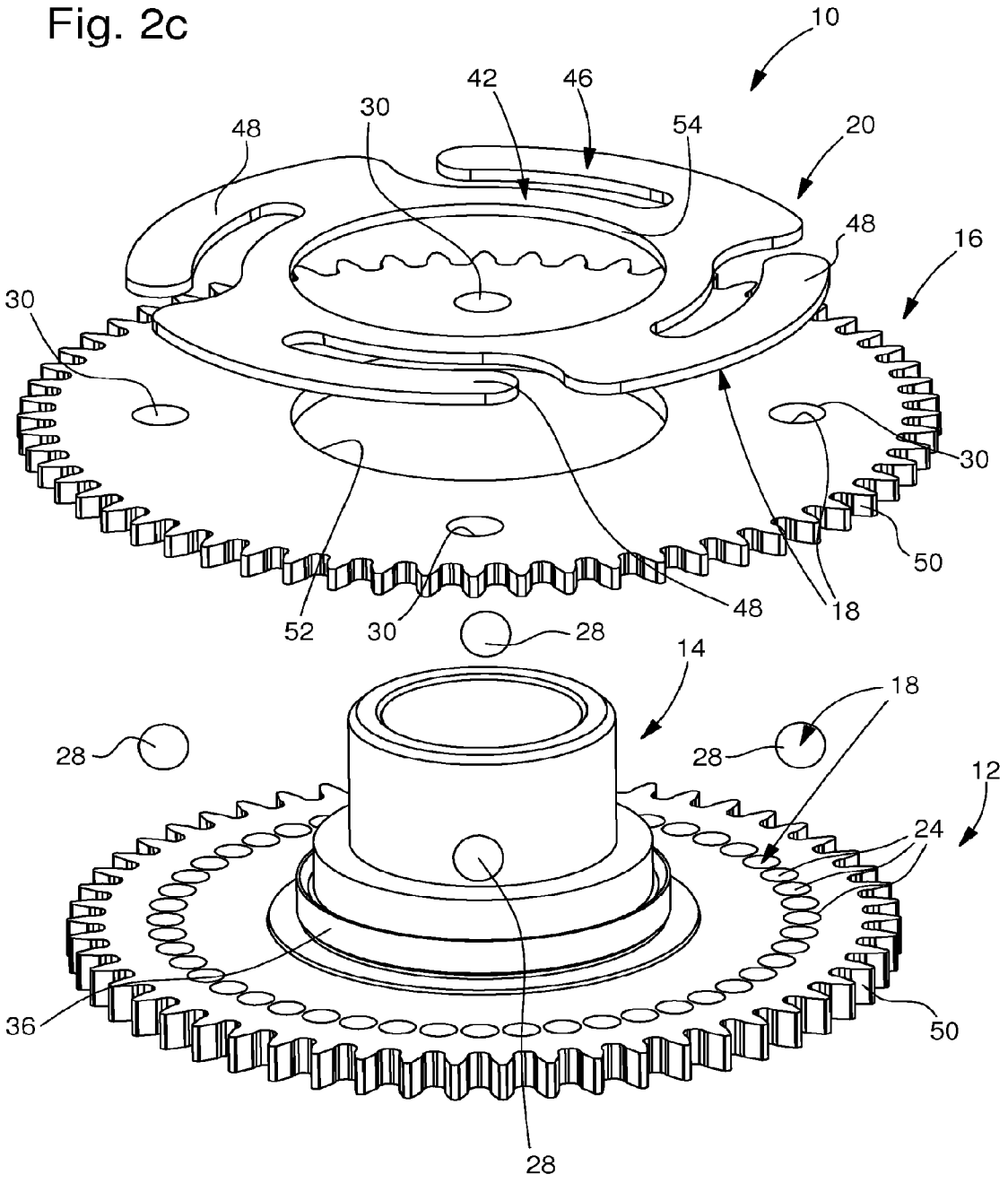
FIG. 2*c* is an exploded perspective view of the device of FIG. 2*a*.

In a first embodiment illustrated in FIGS. 2*a* to 2*c*, spring 20 of jumper mechanism 18 is a separate part assembled to output wheel 16 and made integral therewith. In the illustrated variant, spring 20 includes a securing portion 44 having a central orifice 54 and riveted to hub 14, for example on the wheel securing portion 36 of hub 14. However, other means of securing spring 20 to make it integral with output wheel 16 may be envisaged, for example soldering, adhesive bonding, crimping or riveting. However, driving output wheel 16 and spring 20 onto hub 14 is advantageous due to the simplicity and low cost of this manufacturing step.

In the variant illustrated in FIGS. 2*a* to 2*c*, positioning elements 22 include one or more balls 28 housed in ball housings 30 in the form of holes arranged in output wheel 16 and hollows 24 formed in a surface of input wheel 12. Balls 28 thus define protruding elements 26 configured to engage in hollow elements 24 formed in the surface of input wheel 12. The number of hollows 24 formed in the surface of the input wheel and arranged circularly in a regular manner around the axis of rotation defines the number of notches or relative angular positions between the output wheel and the input wheel.

It is possible to have only one protruding element, for example in this embodiment a single ball 28, however it is preferable to have at least two balls in diametrically opposite positions in order to balance the axial thrust force on wheels 12, 16. Preferably, there are at least four protruding elements distributed in a uniform manner, i.e. every 90°, to obtain a stable and balanced axial thrust force on input wheel 12, and the number of protruding elements may be greater than four. By having at least four protruding elements 26 engaging in hollow elements 24, the force applied to each protruding element can be reduced compared to a configuration having one, two or three protruding elements, which overall provides improved control of the disengagement torque. Indeed, by increasing the number of protruding elements, the pressing force in the hollow of each element is reduced and consequently shocks are reduced when the protruding element jumps from one hollow and then engages in the next.

In the embodiment of FIG. 2*a*, spring 20 may take the form of a flat disc, for example a disc formed from a stamped metal sheet including a base portion 42 forming central hole 54 configured to be riveted to hub 14, and an elastic portion 46 including elastic arms 48, the end of which is configured to bear against a ball 28. The base portion of the spring may be pressed against wheel 16, however, it is also possible to have a space between the spring and the wheel. In a simplified variant, the spring is formed by a simple, flat, relatively thin disc which presses on the balls. In another variant, this disc has openings which increase its capacity for axial elastic deformation.

The diameter of balls 28 is greater than the thickness of output wheel 16 so that each ball projects beyond the two main faces of the wheel in order to be pressed on one side by the elastic arm of the spring and on the other side to be housed inside one of hollows 24. It is however possible to envisage, in a variant, having a ball whose diameter is essentially identical or smaller than the thickness of the output wheel, and in that case the end of the spring may include an extension configured to be inserted into the hole and to press on the ball under the surface of the wheel.

In an alternative variant, it is also possible to have a protruding shape at the end of the spring arm which extends across housings 30 configured to engage with hollows 24, i.e. without having balls or other intermediate parts.

In a variant, it is also possible to form the ball housings in the input wheel and to make the spring integral with the input wheel, mounted on the underside of wheel 12 illustrated in FIG. 2*c*, and to form the hollows in output wheel 16. More generally, the protruding elements may be mounted in input wheel 12 and the hollows in output wheel 16 without departing from the scope of the invention.

Figure 3:
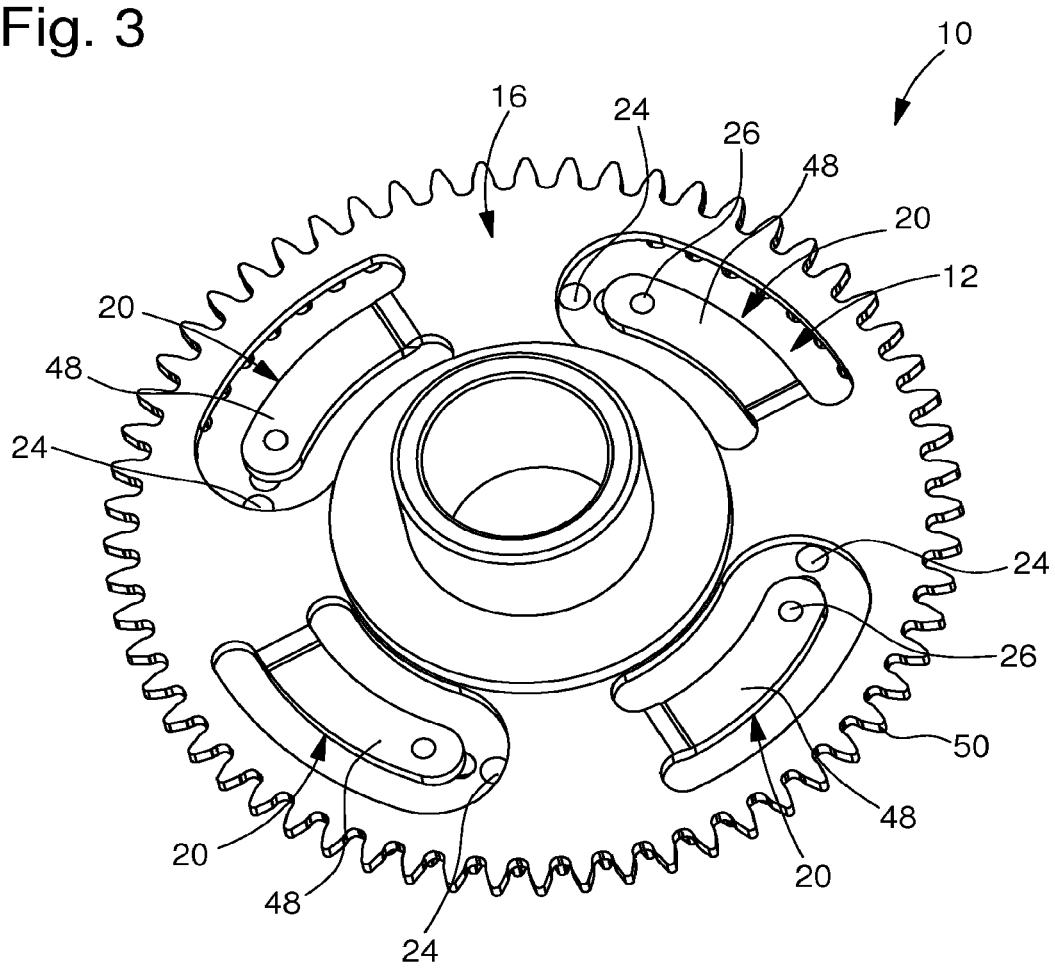
FIG. 3 is a perspective view of a disengageable wheel device according to a second embodiment of the invention.

Referring to FIG. 3, another embodiment is illustrated, in which jumper mechanism 18 is integrated directly in the output and input wheels 16, 12. Input wheel 12 may be identical or similar to the input wheel of the first embodiment described above. Output wheel 16 includes a spring 20 and protruding elements 26, forming an integral part of the output wheel. In an advantageous variant, wheel 16 may take the form of a disc that is essentially flat or of small thickness, for example a disc formed from a stamped metal sheet, spring 20 then including elastic arms 48 stamped in the disc. The protruding elements may be made by stamping a protuberance in each arm 48 close to the end thereof, the protuberances being configured to engage in hollows 24 of input wheel 12. In this embodiment, output wheel 16 may also be driven onto hub 14 or made integral therewith by other means such as soldering, adhesive bonding or crimping. Again in this embodiment, the spring arms and the protruding elements may be integrated in input wheel 12 and the hollows integrated in output wheel 16 without departing from the scope of the invention.

What is claimed is:

1. A mechanism with coaxial disengageable wheels for a timepiece movement comprising:

an input wheel, an output wheel, a hub, and a jumper mechanism including a spring and positioning elements defining a certain number of discrete angular positions of the input wheel with respect to the output wheel around an axis of rotation, the axis of rotation defining an axial direction, the positioning elements including hollow elements and protruding elements, the spring being configured to apply an elastic force pushing the protruding elements against the hollow elements to couple the wheels to each other below a disengagement torque, wherein the protruding elements and the hollow elements extend in the axial direction and the spring is configured to apply the elastic force in the axial direction, and wherein the positioning elements include one or more balls forming the protruding elements, the balls being housed in ball housings in the form of holes disposed in one of the input or output wheels, and the hollow elements are formed in a surface of the other wheel.

2. The disengageable wheel mechanism of claim 1, wherein the jumper mechanism includes a plurality of the protruding elements distributed in a uniform manner around the axis of rotation.

3. The disengageable wheel mechanism of claim 1, wherein there are at least four of the protruding elements.

4. The disengageable wheel mechanism of claim 1, wherein the spring is in the form of an essentially flat disc defining a base portion forming a central hole, configured to be mounted around the hub, and an elastic portion including at least one elastic arm whose end is configured to press one of the protruding elements into one of said hollow elements.

5. The disengageable wheel mechanism of claim 1, wherein the spring is formed from a stamped metal sheet.

6. The disengageable wheel mechanism of claim 1, wherein the hollow elements are arranged close to a periphery of said output or input wheel.

7. The disengageable wheel mechanism of claim 1, wherein the spring includes a securing portion having a central orifice that is fixed to said hub.

8. The disengageable wheel mechanism of claim 1, wherein the input wheel includes the hollow elements and the output wheel includes or is integral with the spring.

9. A timepiece movement including the mechanism with coaxial disengageable wheels according to claim 1, one of the wheels of the disengageable wheel mechanism being engaged with a drive wheel of a drive device of the movement and the other wheel of the disengageable wheel mechanism being engaged with a correction wheel of a correction device of the movement.

10. The timepiece movement of claim 9, wherein the disengageable wheel mechanism also engages with a drive wheel of a date disc of the movement.

11. The timepiece movement according to claim 9, wherein the movement further includes a hand or another display member mounted on the hub of the disengageable wheel mechanism.

12. The timepiece movement according to claim 10, wherein the movement further includes a hand or another display member mounted on the hub of the disengageable wheel mechanism.

13. A mechanism with coaxial disengageable wheels for a timepiece movement comprising:

an input wheel, an output wheel, a hub, and a jumper mechanism including a spring and positioning elements defining a certain number of discrete angular positions of the input wheel with respect to the output wheel around an axis of rotation, the axis of rotation defining an axial direction, the positioning elements including hollow elements and protruding elements, the spring being configured to apply an elastic force pushing the protruding elements against the hollow elements to couple the wheels to each other below a disengagement torque, wherein the protruding elements and the hollow elements extend in the axial direction, and the spring is configured to apply the elastic force in the axial direction with elastic arms of the spring that each extend in a same circumferential direction around the axis of rotation.

14. The disengageable wheel mechanism of claim 13, wherein the spring is entirely formed of one of said input or output wheels, and said protruding elements are made in the form of protuberances on the elastic arms of the spring.

* * * * *